US005597163A

United States Patent [19]

Takemoto et al.

[11] Patent Number: 5,597,163

[45] Date of Patent: Jan. 28, 1997

[54] GAMING MACHINE ISLANDS AND GAMING HOUSE FACILITIES WHERE THE GAMING MACHINE ISLANDS ARE INSTALLED

[75] Inventors: Takatoshi Takemoto; Kazunari Kawashima, both of Tokyo, Japan

[73] Assignee: Kabushiki Kaisha Ace Denken, Japan

[21] Appl. No.: 338,622

[22] PCT Filed: May 19, 1993

[86] PCT No.: PCT/JP93/00652

§ 371 Date: Nov. 18, 1994

§ 102(e) Date: Nov. 18, 1994

[87] PCT Pub. No.: WO93/23124

PCT Pub. Date: Nov. 25, 1994

[30] Foreign Application Priority Data

May 19, 1992 [JP] Japan ..... 4-126455

[51] Int. Cl.[6] ..... A63F 7/36

[52] U.S. Cl. ..... 273/309; 273/121 B

[58] Field of Search ..... 273/121 B, 309

[56] References Cited

FOREIGN PATENT DOCUMENTS 53-53007 5/1978 Japan .

63-195047 12/1988 Japan .

1-137061 5/1989 Japan .

1-82233 6/1989 Japan .

3-783 1/1991 Japan .

3-49788 3/1991 Japan .

*Primary Examiner*—Benjamin H. Layno

*Attorney, Agent, or Firm*—Andrus, Sceales, Starke & Sawall

[57] ABSTRACT

Gaming house facilities having one or more gaming machine islands (1) each comprising a plurality of machines containing at least a plurality of gaming machines (11) placed-side by side, and a floor (31) on which the gaming machine islands are placed are disclosed. The gaming machine island (1) comprises an island pillar unit (10) for fixing and supporting the machines and placing the machines in two rows for forming the gaming machine island, a base frame (22) being installed on the floor for fixing and supporting the island pillar unit, and a plurality of extending frames (21) being placed at predetermined intervals along a length direction of the base frame and being attached to the base frame in a condition of crossing the base frame in a width direction thereof.

15 Claims, 6 Drawing Sheets

GAMING MACHINE ISLANDS AND GAMING HOUSE FACILITIES WHERE THE GAMING MACHINE ISLANDS ARE INSTALLED

TECHNICAL FIELD

This invention relates to gaming machine islands, each comprising a plurality of gaming machines placed side by side, gaming house facilities where the gaming machine islands are installed, and floor block members to form a double floor structure in the gaming house.

TECHNICAL BACKGROUND

A plurality of gaming machine islands each comprising a plurality of gaming machines placed side by side are situated in a gaming house.

Hitherto, a gaming machine island has been installed on the floor of a gaming house as follows: First, marks indicating positions at which the corners of the island are to be placed are drawn on the floor. Next, support members for supporting the gaming machine island are placed according to the marks. Holes are bored in the floor with a drill, and the island is then fixed with anchors for each support member.

After the gaming machine island is installed, chairs, one corresponding to each gaming machine in the island, are fixed on the floor. Thus, additionally, holes are bored in the floor and the chairs are attached.

By the way, signal and power cables are connected to the gaming machine island. These cables are hung from the ceiling for wiring purpose for reasons that there is a danger that players may stumble over the cables, that exposed cables will spoil the appearance of the interior of the gaming house, etc. For example, the cables are trained over the ceiling and passed through the inside of a stainless pipe extending from the ceiling to the island top, for wiring purpose.

However, such conventional art involves fixing the support members for forming the gaming machine island on the floor and the additional installation of chairs; it is cumbersome and takes time, increasing execution costs.

Also, the conventional art involves training the signal and power cables, etc., over the ceiling and bringing down the wiring to the island top from the ceiling; excessive equipment is installed on the ceiling of the gaming house and there is a danger of spoiling the appearance of the interior of the gaming house.

DISCLOSURE OF INVENTION

It is therefore a first object of the invention to provide a gaming machine island that can be installed on a floor of a gaming house rapidly and easily for reducing execution costs and gaming house facilities where the gaming machine island is installed.

It is a second object of the invention to provide a gaming machine island for facilitating installation of chairs and gaming house facilities where the gaming machine island is installed.

It is a third object of the invention to provide gaming house facilities where signal cables, etc., can be placed on the floor for wiring purpose and where block members are used for the gaming house facilities.

To accomplish the first object, according to a first form of the invention, there are provided gaming house facilities having one or more gaming machine islands each comprising a plurality of machines, containing at least a plurality of gaming machines, placed side by side and a floor on which the gaming machine islands are placed, which are characterized by:

an island pillar unit for fixing and supporting the machines and placing the machines in two rows for forming the gaming machine island;

a base frame being installed on the floor for fixing and supporting the island pillar unit; and a plurality of extending frames being placed at predetermined intervals along a length direction of the base frame and being attached to the base frame in a condition of crossing the base frame in a width direction thereof.

The extending frames can be attached to positions being in contact with the floor. The extending frames can be placed corresponding to positions at which the gaming machines are placed. Further, each of the extending frames can have a horizontal part being in contact with the floor and vertical parts formed vertically at ends of the horizontal part.

According to another form of the invention to accomplish the object, there is provided a gaming machine island comprising a plurality of machines containing at least a plurality of gaming machines placed side by side and being placed in a gaming house, which is characterized by:

an island pillar unit for fixing and supporting the machines and placing the machines in two rows for forming the gaming machine island;

a base frame being installed on the floor for fixing and supporting the island pillar unit; and a plurality of extending frames being placed at predetermined intervals along a length direction of the base frame and being attached to the base frame in a condition of crossing the base frame in a width direction thereof.

To accomplish the second object, according to one form of the invention, there are provided gaming house facilities wherein the gaming machine island having the above mentioned structure has chairs being in a one-to-one correspondence with the gaming machines. Each of the chairs can have a seat and a support for supporting the seat, and each of the vertical parts of the extending frames can have the end as a support reception part for supporting the support.

To accomplish the third object, according to one form of the invention, there are provided block members distributed over a floor of a gaming house for forming a second floor face on the top of the block members, each of the block members consisting of a top part providing the second floor face in a separation condition from the floor face and leg parts extending downward from the top part for supporting the top part in a substantially horizontal condition.

According to another form, there are provided gaming house facilities including the block members distributed over a floor for forming a second floor face on the top of the block members.

Each of the block members consists of a top part providing the second floor face in a separation condition from the floor face and leg parts extending downward from the top part for supporting the top part in a substantially horizontal condition. Each of the block members can have a height virtually equivalent to that of the base frame. Further, the leg parts of the block member can have each a length such that the height of a space between the top part rear and floor face provided by the leg parts is greater than the height of the horizontal part of the extending frame from the floor face.

The horizontal parts of the extending frames and the signal and power cables connected to the gaming machine island etc. are housed in the space. In addition, a transport line for transporting game play media used with the gaming machines can be provided.

The gaming machine island is supported by means of the base frame. The extending frames are attached to the base frame in a direction crossing the base frame, whereby the gaming machine island increases in stability and can support itself on the floor.

Thus, the work required for fixing a plurality of support members for supporting the gaming machine island on the floor one by one can be omitted.

Each chair is attached to the vertical part of the extending frame, thereby omitting work for mounting the chairs on the floor, thereby making it possible to install the gaming house facilities rapidly and easily.

The block members are placed surrounding the base frames supporting the gaming machine islands and between the gaming machine islands. The block members are spread all over the floor, whereby their top surface provides the second floor, that is, a double floor structure is provided, whereby the base frames supporting the gaming machine islands are surrounded and concealed. The extending frames, cables, etc., are housed in the space provided by the leg parts of the block members and do not appear on the second floor. That is, the gaming machine islands appear to be placed directly on the second floor. Therefore, they do not appear on the floor, the interior of the gaming house is not made untidy. The extending frames, cables, etc., do not obstruct cleaning of the floor or invite instability at the customer's feet or make customers uncomfortable. The cables need not be put on the ceiling for wiring purposes, and thus wiring work is facilitated.

BEST MODE FOR CARRYING OUT THE INVENTION

Referring now to the accompanying drawings, there is shown one embodiment of the invention.

Figure 1:
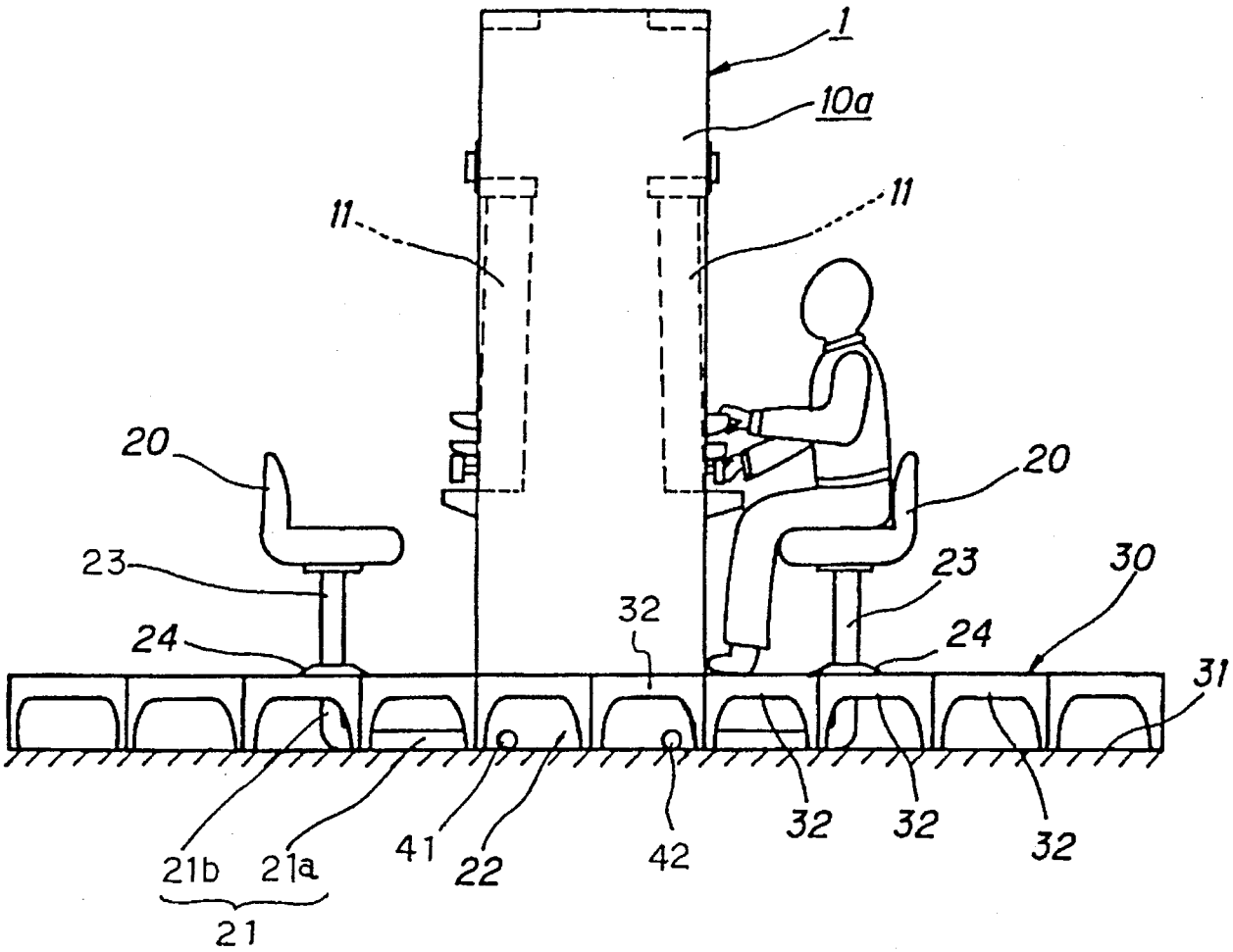
FIG. 1 is a front view showing the configuration of a gaming machine island and gaming house facilities according to one embodiment of the invention.
Figure 2:
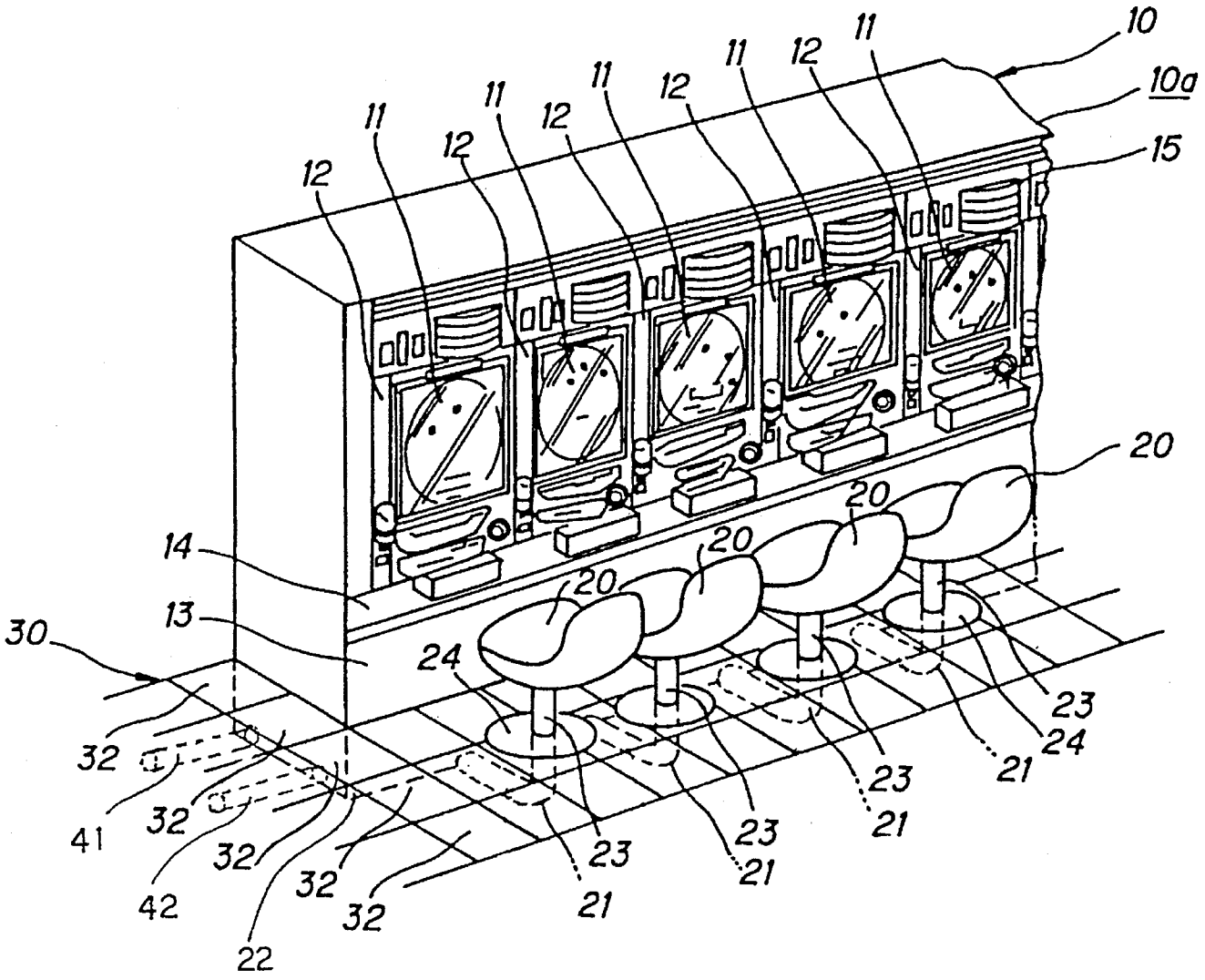
FIG. 2 is a perspective view of the configuration in FIG. 1.

As shown in FIGS. 1 and 2, gaming house facilities of the embodiment comprise a plurality of gaming machine islands 1 installed on a floor 31 in a gaming house.

Figure 5:
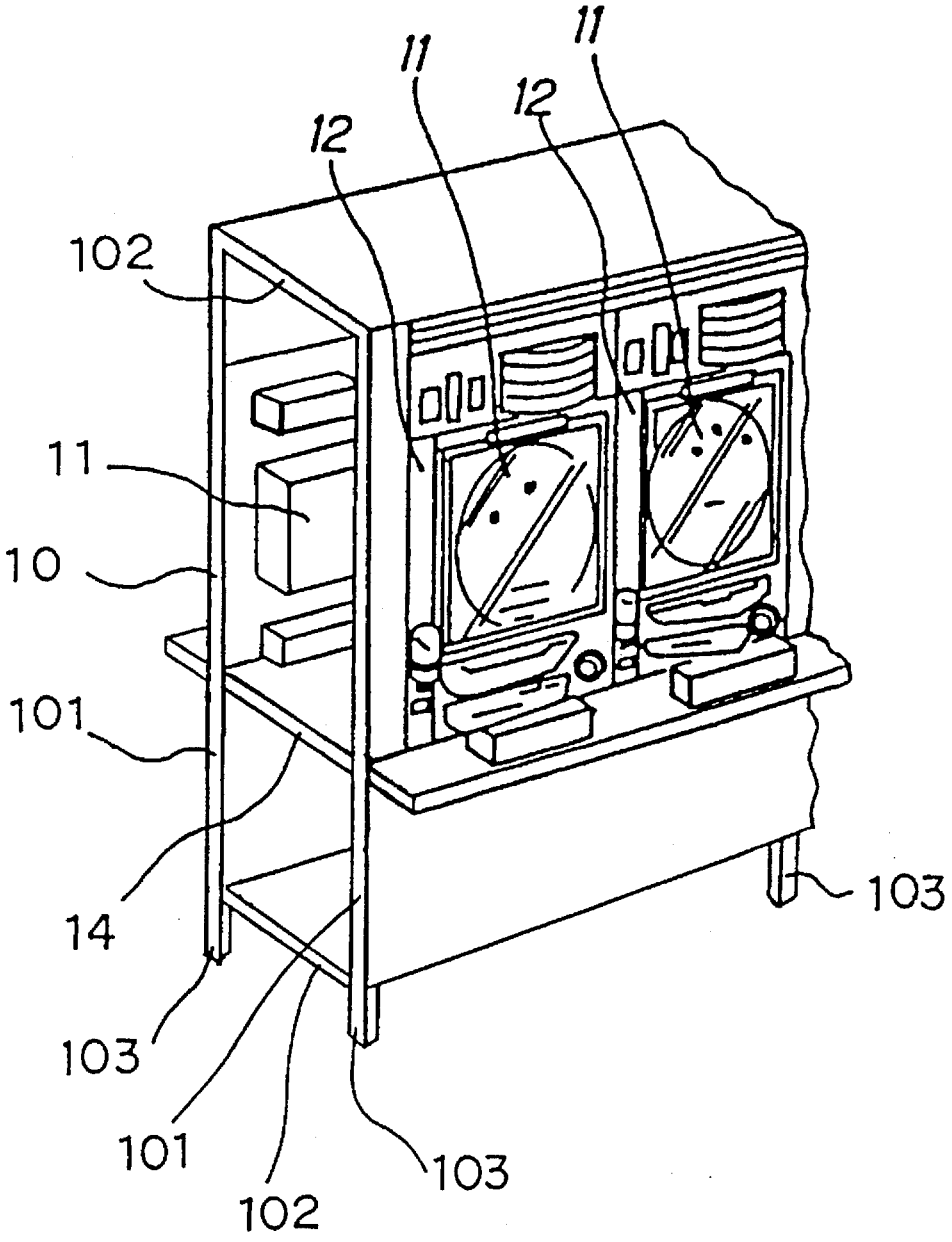
FIG. 5 is a perspective view showing an example of an island pillar unit forming the gaming machine island.

A plurality of machines constitute the gaming machine island 1. In the embodiment, a plurality of gaming machines 1 and game play media lending machines 12 are placed side by side as the machines. In the example, two rows of alternately placed gaming machines 11 and game play media lending machines 12 face in opposite directions, as shown in FIG. 5. In the embodiment, pinball machines are installed as the gaming machines 11. Of course, the invention is not limited to pinball machines. For example, gaming machines such as slot machines can be installed. The game play media lending machines 12 are machines for paying out game play media used with the gaming machines 11 in response to an entered fee. In the embodiment, pinballs used with pinball machines are paid out.

The gaming machine island 1 has a frame-like island pillar unit 10 as shown in FIG. 5. The gaming machines 11 and the game play media lending machines 12 are placed in the frame-like island pillar unit 10 extending in the length direction. The island pillar unit 10 consists of vertical members 101 formed like a pillar and horizontal members 102 placed in a horizontal direction between the vertical members 101 and having both sides fixed to the vertical members 101. Leg parts 103, also serving as fixing members, are formed on the bottom of the vertical members 101.

Figure 4:
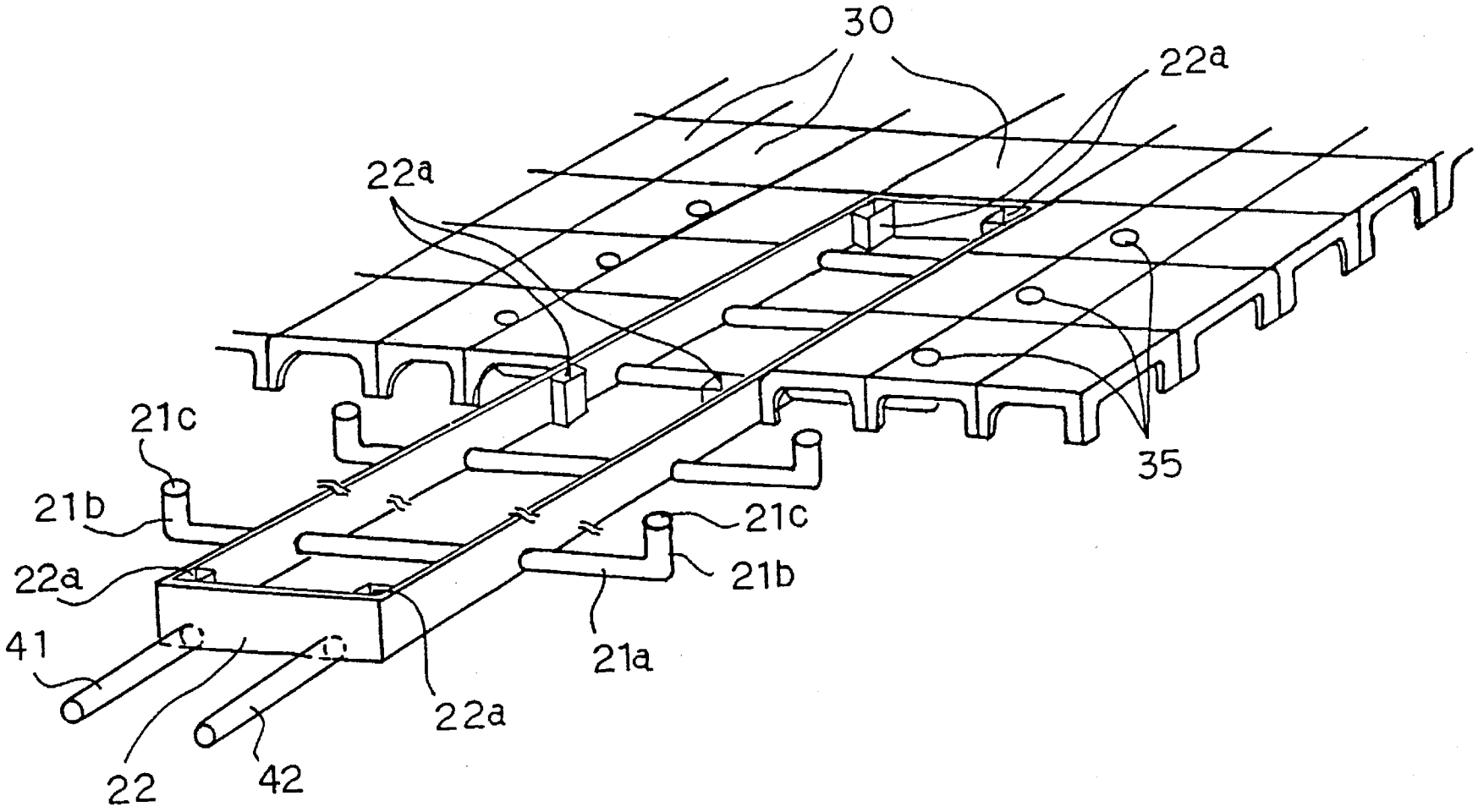
FIG. 4 is an illustration showing a base frame for supporting the gaming machine island and block members placed on the surroundings of the base frame in the gaming house facilities of the invention.

The gaming machine island 1 is installed on a base frame 22 installed on the floor 31. The base frame 22 is made of a frame material having a form corresponding to the plane form of the island, as shown in FIG. 4. That is, it is formed in a shape corresponding to the width and length in the length direction of the gaming machine island 1. The base frame 22 is provided with fixing parts **22*a* to which the leg parts 103 are fitted for fixing at positions corresponding to the positions of the leg parts 103 of the island pillar unit 10. The base frame 22 supports the gaming machine island 1** in a self-supporting fashion.

As shown in FIG. 4, piping 41 for housing signal and power cables and piping 42 for transporting game play media are connected to one end of the base frame 22.

A predetermined number of extending frames 21 are fixed to the base frame 22 at predetermined installation positions along the length direction of the base frame 22. Assuming that a number of the extending frames 21, which is the number of portions extending from the base frame 22 to the outside, is counted, the number of the extending frames 21 corresponds to the number of the gaming machines 11 placed on the gaming machine island 1 supported by the base frame 22. That is, the number of the base frame 22 itself is a half of that the number of the extending frames 21. The installation position of each extending frame 21 is placed at almost the center of each gaming machine 11 placed on the gaming machine island 1, because one end of the extending frame 21 is used as a reception part of a support of a chair 20 as described below.

The extending frame 21 consists of a horizontal part **21*a* and vertical parts 21*b***. The horizontal and vertical parts are formed as a unit in the embodiment. That is, both ends of a metal pipe are bent upwards at right angle.

The horizontal part **21*a* is attached to the base frame 22 so as to cross the base frame 22 and when the base frame 22 is installed on floor 30, so as to come in contact with the floor 30. The extending frame 21 has the horizontal part 21*a* extending to the outside of the base frame 22 for stabilization to prevent the gaming machine island 1** from tipping over.

The vertical parts **21*b* are placed so that their ends become the height almost matching the top of the block members 32** described below. In the embodiment, the vertical parts 21*b* are installed so as to also match the height of the base frame 22. That is, the base frame 22 and the vertical parts 21*b* are the same in height. The distance of the vertical part 21*b* from the base frame 22 is determined by considering that the vertical part 21*b* is used to receive the support of a chair, as described below.

The top end of the vertical part 21*b* of the extending frame 21 provides a reception part 21*c* of the tip of a support part 23 of the chair 20 for players.

Figure 6:
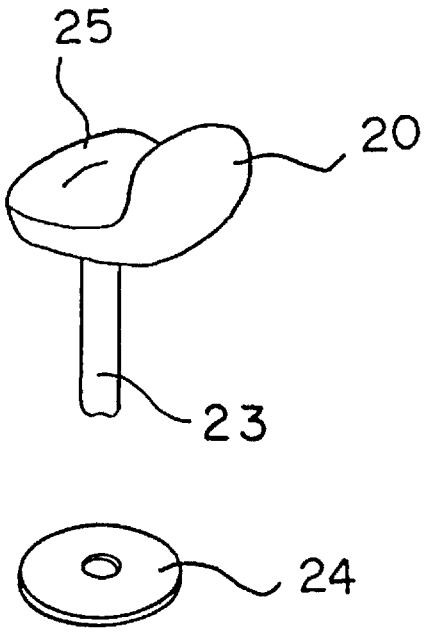
FIG. 6 is a perspective view showing an example of the structure of a chair.

The chairs 20 are placed in a one-to-one correspondence with the gaming machines, as shown in FIG. 2. The chair 20 consists of a seat 25, a support 23 for supporting the seat 25, and a cover 24 for covering the surroundings of the reception part 21*c*, as shown in FIG. 6. The cover 24 is placed on the second floor 30. The chair 20 may be rotatably secured in a horizontal direction to the chair support part 23.

The gaming machine island 1 will be discussed in more detail. As shown in FIG. 2, a panel 13 is mounted on the lower part of the island pillar unit 10. The panel 13 has the upper end to which a top 14 is substantially horizontally fixed, for holding the gaming machines 11 and the game play media lending machines 12. A screen plate 15 on which indicator lamps are mounted is attached to the upper end of the island pillar unit 10.

As shown in FIGS. 1 and 2, the floor 31 is covered with block members 32 for concealing the extending frames 21 and the base frame 22. Thus, the floor of the gaming house has a double structure consisting of the original floor 31 and the second floor 30 formed as the top of the block members 32 distributed over the floor 31.

Figure 3:
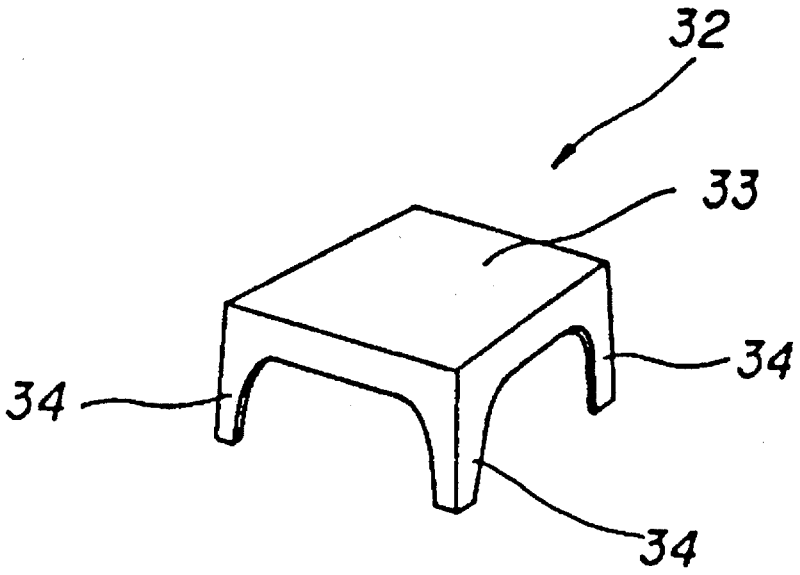
FIG. 3 is a perspective view showing the structure of an example of a block member distributed over a floor in the gaming house facilities according to the embodiment.

As shown in FIG. 3, the block member 32 consists of a top part 33, providing the second floor 30 separately from the floor 31, and leg parts 34 extending downward from the top part 33 for supporting the top part 33 in a substantially horizontal condition. More particularly, the top part 33 is formed substantially like a rectangle and the four leg parts 34, 34 . . . are extended from the lower parts of the four corners of the top part 33. The form of the top part 33 is not limited to the rectangle; it may be a different form if the form allows the block members to be closely distributed over the second floor 30 without any clearance. The block members 32 may be made of any material if strength is maintained. For example, they can be made of concrete blocks, etc.

The form and size of the top part of the block member 32 can be determined in relation to those of the base frame. For example, they are determined as the form and size that can surround the base member 22 without any clearance. The block members 32 need not be of the same size; block members 32 of different forms and sizes can also be provided.

Next, the function of the embodiment will be described.

First, to build the gaming house facilities of the embodiment, a mark is drawn at the position where a gaming machine island is to be established on the floor of the gaming house. The base frame 22 together with the extending frames 21 fixed thereto is placed on the floor 31 along the mark. Next, anchors are struck into appropriate points on the floor for fixing appropriate parts of the base frame 22 and the extending frames 21.

Next, the island pillar unit 10 is placed on the base frame 22 with the leg parts 103 of the island pillar unit 10 fitted into the fixing parts 22*a*. Necessary signal and power cables are drawn into the piping 41. The piping 42 containing a game play media transport mechanism is connected. The gaming machines 11 and the game play media lending machines 12 are mounted on the island pillar unit 10. Necessary wires are connected, etc., then members such as the panels 13 are mounted for completing the gaming machine island 1.

Next, the block members 32 are distributed over the floor 31. At this time, a block member having a hole 35 into which the vertical part 21*b* of the extending frame 21 can be inserted is placed in the portion containing the vertical part 21*b*.

After the block members 32 are distributed over the floor 31, the chairs 20 are assembled. That is, with the cover 24 fitted into the support 23, the tip of the support is fitted into the reception part 21*c* of the extending frame 21. Then, the chair 20 is rotatably fixed.

Such a structure allows the gaming machine island 1 to be supported on the base frame 22 in a self-supporting fashion and to be stabilized by means of the extending frames 21. The signal and power cables and the game play media transport mechanism are housed in the pipings 41 and 42 and covered with the block members 32. Further, the chairs, which are supported by means of the vertical parts of the extending frames 21, can be easily supported and fixed. The extending frames 21 are also covered with the block members 32.

Since the second floor 30 is provided as the top of the block members 32, the cables, mechanism members, etc., are not exposed to the floor, and only the gaming machine island 1 and the chairs 20 appear on the floor. Therefore, obstacles are excluded from customer's feet, improving both the safety and the appearance of the gaming house drastically. Cleaning, etc., is also facilitated.

Necessary block members can be taken out for maintenance inspection, repair, etc., thus the jobs can be executed easily and quickly.

The gaming machines forming the gaming machine island according to the embodiment may be various gaming machines, such as arrange ball machines and slot machines, as well as pinball machines.

We claim:

1. Gaming house facilities having one or more gaming machine islands each comprising a plurality of machine rows, each containing a plurality of gaming machines placed side by side, and a floor on which the gaming machine islands are placed, which are characterized by:

an island pillar unit for fixing and supporting the machines and placing the machines in two rows for forming the gaming machine island;

a base frame installed on the floor for fixing and supporting said island pillar unit, said base frame having a pair of spaced, opposing frame members lying along a length direction of said base frame, said frame members being in contact with the gaming house floor along substantially their entire length when the base frame is in use; and a plurality of extending frames attached to said base frame at predetermined intervals along a length direction of said base frame, said extending frames extending in a width direction of said base frame, said extending frames having central portions lying between said frame members and extending portions extending beyond said frame members in the width direction of said base frame, said extending frames being placed corresponding to positions at which the gaming machines are placed and being in contact with the floor along substantially the entire length of a horizontal part thereof when the base frame is in use for stabilizing said base frame on the gaming house floor.

2. The gaming house facilities as claimed in claim 1, wherein each of said extending frames has vertical parts integrally formed with said horizontal part vertically at ends of the horizontal part.

3. The gaming house facilities as claimed in claim 2 wherein said gaming machine island has chairs in a one-to-one relationship with same gaming machines, said chairs having a seat and a vertical extending support for supporting the seat, and wherein each of said vertical parts of said extending frame has an end forming a support reception part for receiving said support of a chair.

4. The gaming house facilities as claimed in claim 3 further including a plurality of block members distributed over the floor for forming a second floor face on a top of said block members, each of said block members comprising a top part providing the second floor face separately from said floor face and leg parts extending downward from said top part for supporting said top part in a substantially horizontal condition.

5. The gaming house facilities as claimed in claim 4 wherein each of said block members has a height substantially equivalent to that of said base frame.

6. The gaming house facilities as claimed in claim 5 wherein the leg parts of said block member each have a length such that a height of a space between a lower face of the top and a floor face which is provided by the leg parts is greater than a height of the horizontal part of said extending frame from the floor face.

7. The gaming house facilities as claimed in claim 6 wherein the horizontal parts of said extending frames are each housed in a space between the lower face of the top of said block member and the floor face.

8. The gaming house facilities as claimed in claim 7 wherein said block members each have the top part of a form and size that can surround said base frame without any clearance when they are distributed on the surroundings of said base frame.

9. The gaming house facilities as claimed in claim 2 wherein each of said extending frames is made of a pipe.

10. The gaming house facilities as claimed in claim 6 further including signal and power cables connected to said gaming machine islands, said signal and power cables being housed in the space between the lower face of the top of said block members and the floor face.

11. The gaming house facilities as claimed in claim 6 further including signal and power cables connected to the gaming machine island, said signal and power cables being housed in the space between the lower face of the top of the block member and the floor face.

12. The gaming house facilities as claimed in claim 11 further including piping for housing said signal and power cables and piping for transporting game play media, said pipings being housed each in the space between the lower face of the top of the block member and the floor face.

13. The gaming house facilities as claimed in claim 12 wherein said piping for housing said signal and power cables and said piping for transporting game play media are connected to at least one end of said base frame.

14. A gaming machine island comprising a plurality of machine rows, each containing at least a plurality of gaming machines placed side by side and being placed in a gaming house, which is characterized by:

an island pillar unit for fixing and supporting the machines and placing the machines in two rows for forming the gaming machine island;

a base frame installed on the floor for fixing and supporting said island pillar unit, said base frame having a pair of spaced, opposing frame members lying along a length direction of said base frame, said frame members being in contact with the gaming house floor along substantially their entire length when the base frame is in use; and a plurality of extending frames attached to said base frame in correspondence to positions at which the gaming machines are placed along a length direction of said base frame, said extending frames extending in a width direction of said base frame, said extending frames having central portions lying between said frame members and extending portions extending beyond said frame members in the width direction of said base frame, said extending frames each having a horizontal part in contact with the floor along substantially its entire length when said base frame is in use and vertical parts formed vertically at ends of the horizontal part, said horizontal parts including the central portions lying between said frame members, said horizontal parts and said vertical parts being integrally made of pipe as a unit for each extending frame, said horizontal parts stabilizing said base frame on the floor;

said gaming machine island having chairs in one-to-one correspondence with the gaming machines, each of said chairs having a seat and a support for supporting the seat, said vertical parts of said extending frame each having an end forming a support reception part for receiving said support of a chair.

15. The gaming house facilities as claimed in claim 14 further including a plurality of game play media lending machines as the machines, said game play media lending machines being placed alternately with the gaming machines in a row.

* * * * *